US007699441B2

(12) United States Patent
Lebens

(10) Patent No.: US 7,699,441 B2
(45) Date of Patent: Apr. 20, 2010

(54) LIQUID DROP EJECTOR HAVING IMPROVED LIQUID CHAMBER

(75) Inventor: John A. Lebens, Rush, NY (US)

(73) Assignee: Eastman Kodak Company, Rochester, NY (US)

( * ) Notice: Subject to any disclaimer, the term of this patent is extended or adjusted under 35 U.S.C. 154(b) by 559 days.

(21) Appl. No.: 11/609,375

(22) Filed: Dec. 12, 2006

(65) Prior Publication Data

US 2008/0136868 A1 Jun. 12, 2008

(51) Int. Cl.
*B41J 2/05* (2006.01)

(52) U.S. Cl. ..... 347/64; 347/65

(58) Field of Classification Search ..... 347/64, 347/65

See application file for complete search history.

(56) References Cited

U.S. PATENT DOCUMENTS

| | | | | |
|---|---|---|---|---|
| 5,478,606 | A | 12/1995 | Ohkuma et al. | |
| 6,186,616 | B1 | 2/2001 | Inoue et al. | |
| 6,331,258 | B1 | 12/2001 | Silverbrook | |
| 6,482,574 | B1 | 11/2002 | Ramaswami et al. | |
| 6,513,896 | B1 * | 2/2003 | Kawamura | 347/15 |
| 6,555,480 | B2 | 4/2003 | Milligan et al. | |
| 6,561,627 | B2 | 5/2003 | Jarrold et al. | |
| 6,569,343 | B1 * | 5/2003 | Suzuki et al. | 216/27 |
| 6,676,241 | B2 | 1/2004 | Yabe | |
| 6,739,519 | B2 | 5/2004 | Stout et al. | |
| 6,942,318 | B2 * | 9/2005 | Fartash | 347/44 |
| 7,517,059 | B2 * | 4/2009 | Hayakawa | 347/64 |
| 2003/0025760 | A1 | 2/2003 | Imamura et al. | |
| 2004/0008240 | A1 | 1/2004 | Kubota et al. | |
| 2005/0179744 | A1 | 8/2005 | Sasaki | |
| 2005/0253900 | A1 | 11/2005 | Kim et al. | |
| 2006/0066659 | A1 | 3/2006 | Giovanola et al. | |
| 2006/0114294 | A1 | 6/2006 | Kim | |

FOREIGN PATENT DOCUMENTS

| | | |
|---|---|---|
| EP | 0 895 865 | 2/1999 |
| EP | 1 366 906 | 12/2003 |

* cited by examiner

*Primary Examiner*—Stephen D Meier
*Assistant Examiner*—Geoffrey Mruk
(74) *Attorney, Agent, or Firm*—William R. Zimmerli; David A. Novais

(57) ABSTRACT

A liquid drop ejector includes a substrate and a liquid chamber for receiving a liquid. The liquid chamber is positioned over the substrate and includes a nozzle plate, a chamber wall and a liner layer. The nozzle plate and the chamber wall include an organic material. The liner layer includes an inorganic material. The liner layer is located on the nozzle plate and the chamber wall such that the inorganic material is contactable with the liquid when the liquid is present in the chamber.

13 Claims, 16 Drawing Sheets

Prior Art

LIQUID DROP EJECTOR HAVING IMPROVED LIQUID CHAMBER

CROSS REFERENCE TO RELATED APPLICATIONS

Reference is made to commonly-assigned, U.S. patent application Ser. No. 11/609,365, filed concurrently herewith, entitled "LIQUID EJECTOR HAVING IMPROVED CHAMBER WALLS" in the name of John A. Lebens et al., the disclosure of which is incorporated herein by reference.

FIELD OF THE INVENTION

The present invention relates generally to monolithically formed liquid chambers and, more particularly, to liquid chambers used in ink jet devices and other liquid drop ejectors.

BACKGROUND OF THE INVENTION

Drop-on-demand (DOD) liquid emission devices have been known as ink printing devices in ink jet printing systems for many years. Early devices were based on piezoelectric actuators such as are disclosed by Kyser et al., in U.S. Pat. No. 3,946,398 and Stemme in U.S. Pat. No. 3,747,120. A currently popular form of ink jet printing, thermal ink jet (or "bubble jet"), uses electrically resistive heaters to generate vapor bubbles which cause drop emission, as is discussed by Hara, et al., in U.S. Pat. No. 4,296,421. Although the majority of the market for drop ejection devices is for the printing of inks, other markets are emerging such as ejection of polymers, conductive inks, or drug delivery.

In the past, print head fabrication involved the lamination of a nozzle plate onto the printhead. With this method alignment of the nozzle to the heater is difficult. Also the thickness of the nozzle plate is limited to above a certain thickness. Recently monolithic print heads have been developed through print head manufacturing processes which use photo imaging techniques. The components are constructed on a substrate by selectively adding and subtracting layers of various materials.

Ohkuma et al., in U.S. Pat. No. 5,478,606 discloses a method of monolithically fabricating an ink flow path and chamber with a nozzle plate. FIG. 1 shows the prior art with a substrate 1 containing electrothermal elements 2, and an ink feed port 3. A photo-patternable resin 5 is formed on top of a dissoluble resin that defines the ink flow path including chamber 4. The dissoluble resin is subsequently removed to form the ink flow path and chamber.

In this method of forming ink flow path and chamber; the adjoining of the substrate 1 containing the electrothermal elements 2 and the ink flow path-forming member relies on the adhesion force of the resin 5 constituting the flow path-forming member. In the ink jet head, the flow path and chamber is constantly filled with ink in the normal state of use so that the periphery of the adjoining portion between the substrate and the flow path-forming member is in constant contact with the ink. Therefore, if the adjoining is achieved by the adhesion force only of the resin material, constituting the flow path-forming member, this adhesion can be deteriorated by the influence of the ink. The adhesion is especially poor in alkaline inks.

In addition, in most thermal ink jet heads the resin material adheres to in different regions an inorganic layer such as silicon nitride or silicon oxide. In other regions the resin is adhering to a tantalum layer used for cavitation protection.

Such tantalum layer has a lower adhesion force than the silicon nitride layer to the resinous material constituting the flow path-forming member. Therefore the resin may peel off of the tantalum layer. In order to prevent this from occurring, Yabe in U.S. Pat. No. 6,676,241 discloses forming an adhesion layer composed of polyetheramide resin between the substrate and the flow path-forming member. In this case improved adhesion can be maintained between silicon nitride or Tantalum layer and adjoining flow path member resin. However it is important that this adhesion layer be properly patterned so that no portion is in contact with the electrothermal element. Patterning of this layer includes extra steps in the fabrication, increasing expense and lowering yield. Also since the resin constituting the flow path member is still in contact with the ink it could swell causing stresses to develop between it and the adhesion layer again causing delamination of the flow path member.

Stout et al., in U.S. Pat. No. 6,739,519 also discloses a method of monolithically fabricating an ink flow path and chamber with a nozzle plate using photodefinable epoxy over a sacrificial resist layer or alternatively, with a double exposure of a photodefinable epoxy. The patent discusses the problem of continued adhesion between the epoxy nozzle plate and the substrate. Since the epoxy has a much larger thermal coefficient of expansion than the substrate thermal stresses can develop during firing of the heaters leading to delamination. The patent proposes the use of a primer layer between nozzle plate and substrate. However the epoxy interface is still in close proximity to the heater.

The nozzle plate formed from a resin material is gas permeable. Therefore the ink in the chamber below the nozzle plate is subjected to increased evaporation. As a result, properties of the ink, such as viscosity, in the chamber may change causing degradation of ejection characteristics. Also, air from the outside entering the chamber can cause bubble formation again degrading the ejection. Inoue et al., in U.S. Pat. No. 6,186,616 discloses adding a metal layer to the top of the nozzle plate resin to prevent air ingestion. However care must be taken that good adhesion is formed between the resin and metal layer. Also the metal must be compatible with the ink so that it does not corrode. Higher temperature deposited materials cannot be used due to the thermal restrictions of the resin material.

With the inside of a chamber formed with epoxy another issue is the wetting of the chamber walls with the ink. It is important that the inner chamber walls be wetting with the ink. Otherwise priming of the head will be difficult. Also, after a drop is ejected the chamber is depleted of ink and must completely refill before another drop can be fired. Non-wetting walls will impede the refill process. The contact angle of the epoxy wall can be lowered, for example, by exposure to oxygen plasma. However the surface returns to a non-wetting state over time. Also the oxygen plasma roughens the surface of the epoxy that again impedes refill.

It would therefore be advantageous to have an alternative choice for the inner chamber wall that is wetting with the ink, such as silicon oxide or silicon nitride. Such layers have excellent adhesion to the substrate layers used in the printhead. These layers are deposited at high temperatures and have other excellent properties for use in contact with the ink such as; material robustness, low thermal expansion, low moisture absorption and moisture permeability, Ramaswami et al., in U.S. Pat. No. 6,482,574 discloses an all-inorganic chamber by depositing a thick 5-20μm layer of oxide, patterning and etching to form the chamber, filling and planarizing a sacrificial layer, depositing a nozzle plate, and removing the sacrificial material. It is difficult to process such thick layers of oxide with long deposition and etch times. Such thick layers also have a tendency to crack due to stress build-up.

In commonly assigned U.S. Pat. No. 6,644,786 a chamber formation method is disclosed for a thermal actuator drop ejector. Non-photoimageable polyimide is patterned as the sacrificial layer allowing deposition of a high temperature inorganic structural layer such as silicon oxide or silicon nitride to form the chamber walls and nozzle plate. In this case only one deposition of the inorganic layer is needed to define both chamber walls and nozzle plate. Although this process eliminates the disadvantages of a polymer nozzle plate, a silicon oxide layer is a brittle material so that a printhead with chambers made this way can be more fragile. Also, thicker inorganic nozzle plates are harder to produce. Another aspect of an inorganic nozzle plate is that it is difficult to form a nozzle with a retrograde profile. A nozzle with a retrograde profile is advantageous for drop ejection stability and refill.

There is therefore a need for a chamber formation process that provides good adhesion to the substrate, an inner chamber material with good stability and wetting properties with respect to the ink, adjustable nozzle plate thickness, a nozzle with a retrograde profile, and a top surface, which is non-wetting with the ink.

SUMMARY OF THE INVENTION

An object of the present invention to provide a liquid ejector having a mechanically robust liquid chamber adhered to the substrate of the liquid ejector.

It is also an object of the present invention to provide the liquid chamber of the liquid ejector with inner chamber wall material that is stable and wetting with the liquid provided to the chamber so as to improve the lifetime of the liquid chamber.

According to one aspect of the invention, a liquid drop ejector includes a substrate and a liquid chamber for receiving a liquid. The liquid chamber is positioned over the substrate and includes a nozzle plate, a chamber wall and a liner layer. The nozzle plate and the chamber wall include an organic material. The liner layer includes an inorganic material. The liner layer is located on the nozzle plate and the chamber wall such that the inorganic material is contactable with the liquid when the liquid is present in the chamber.

According to another feature of the present invention, a method of manufacturing a liquid ejector includes providing a substrate; and forming a liquid chamber over the substrate and including a nozzle plate, a chamber wall and a liner layer by: providing a first organic material over the substrate; patterning the first organic material to create a location for the chamber wall; forming the liner layer by depositing a layer of inorganic material over the patterned first organic material; forming the nozzle plate and the chamber wall by depositing a second organic material over the inorganic material such that the inorganic material of the liner layer is located on the nozzle plate and the chamber wall and is contactable with liquid when liquid is present in the chamber; and removing a portion of the patterned first organic material.

BRIEF DESCRIPTION OF THE DRAWINGS

In the detailed description of the embodiments of the invention presented below, reference is made to the accompanying drawings, in which.

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

As described below, the present invention provides a method for forming a nozzle plate and chamber for a liquid emission device. The most familiar of such devices are used as printheads in ink jet printing systems. Many other applications are emerging which make use of devices similar to ink jet printheads, however which emit liquids other than inks that need to be finely metered and deposited with high spatial precision. The terms ink jet and liquid drop ejector will be used herein interchangeably. The invention described below also provides for an improved chamber and nozzle plate for a liquid drop ejector.

Figure 1:
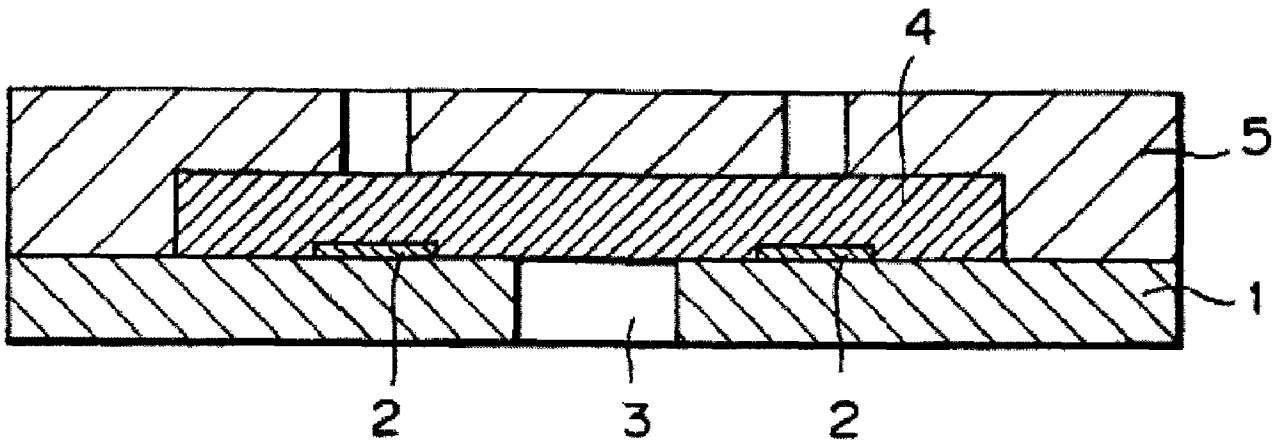
FIG. 1 is a cross-sectional schematic view of an ink jet printhead according to the prior art.
Figure 2:
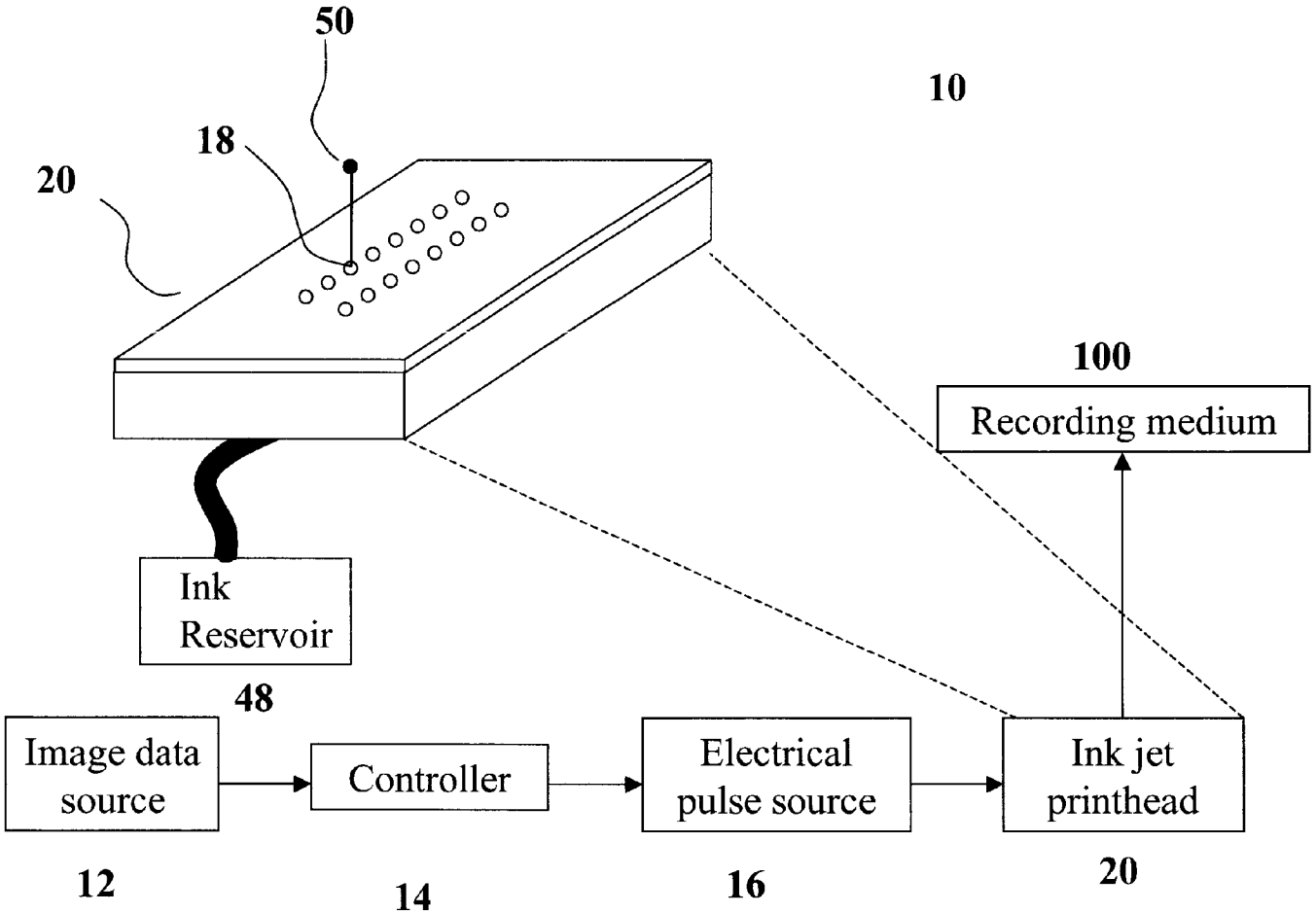
FIG. 2 is a schematic illustration of an ink jet system according to the present invention.

FIG. 2 is a schematic representation of an ink jet printing system 10 that incorporates a liquid ejection device fabricated according to the present invention. The system includes an image data source 12 that provides signals that are received by controller 14 as commands to print drops. Controller 14 outputs signals to a source of electrical pulses 16. Electrical pulse source 16, in turn, generates an electrical voltage signal composed of electrical energy pulses which are applied to electrothermal heaters 2 within ink jet printhead 20. The pulse source 16 can be separate from the printhead. In the preferred embodiment the pulse source 16 is integrated into the printhead. The ink jet printhead 20 contains an array of nozzles 18 and associated electrothermal elements 2. An ink reservoir 48 supplies ink to the printhead. An electrical energy pulse causes ejection of liquid through a nozzle 18, associated with the pulsed electrothermal heater, emitting an ink drop 50 that lands on recording medium 100.

Figure 3A:
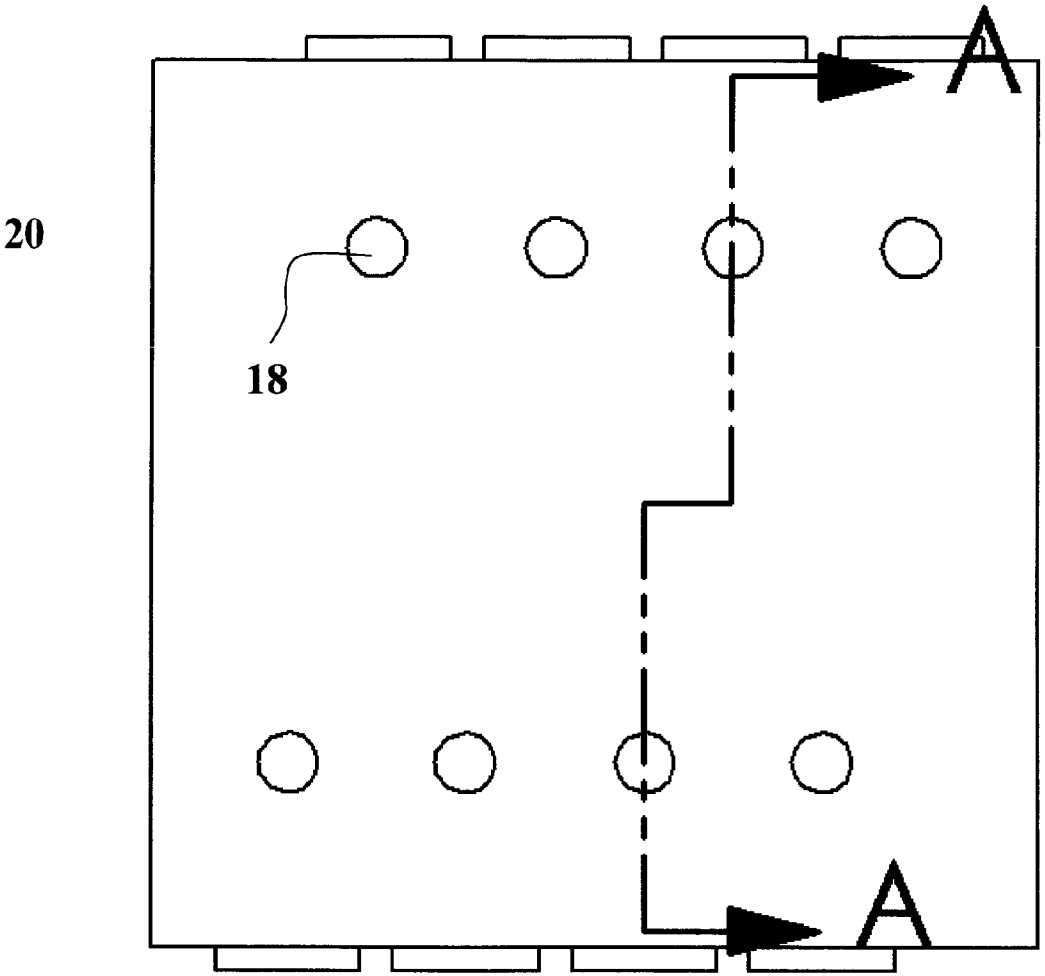
FIGS. 3A and 3B are respectively; a top view of the ink jet printhead shown in FIG. 2 in the vicinity of the nozzles and a cross-sectional view of the ink jet printhead taken along line A-A according to the present invention.

FIG. 3A illustrates a schematic top view of the ink jet printhead 20 of FIG. 2 in the vicinity of the nozzle region. In one embodiment the nozzles 18 are arranged in two rows. The nozzles in each row are offset to give the npi resolution of the head. In other embodiments the nozzle array in each row can be staggered or the nozzles can be patterned in a 2 dimensional array.

Figure 3B:
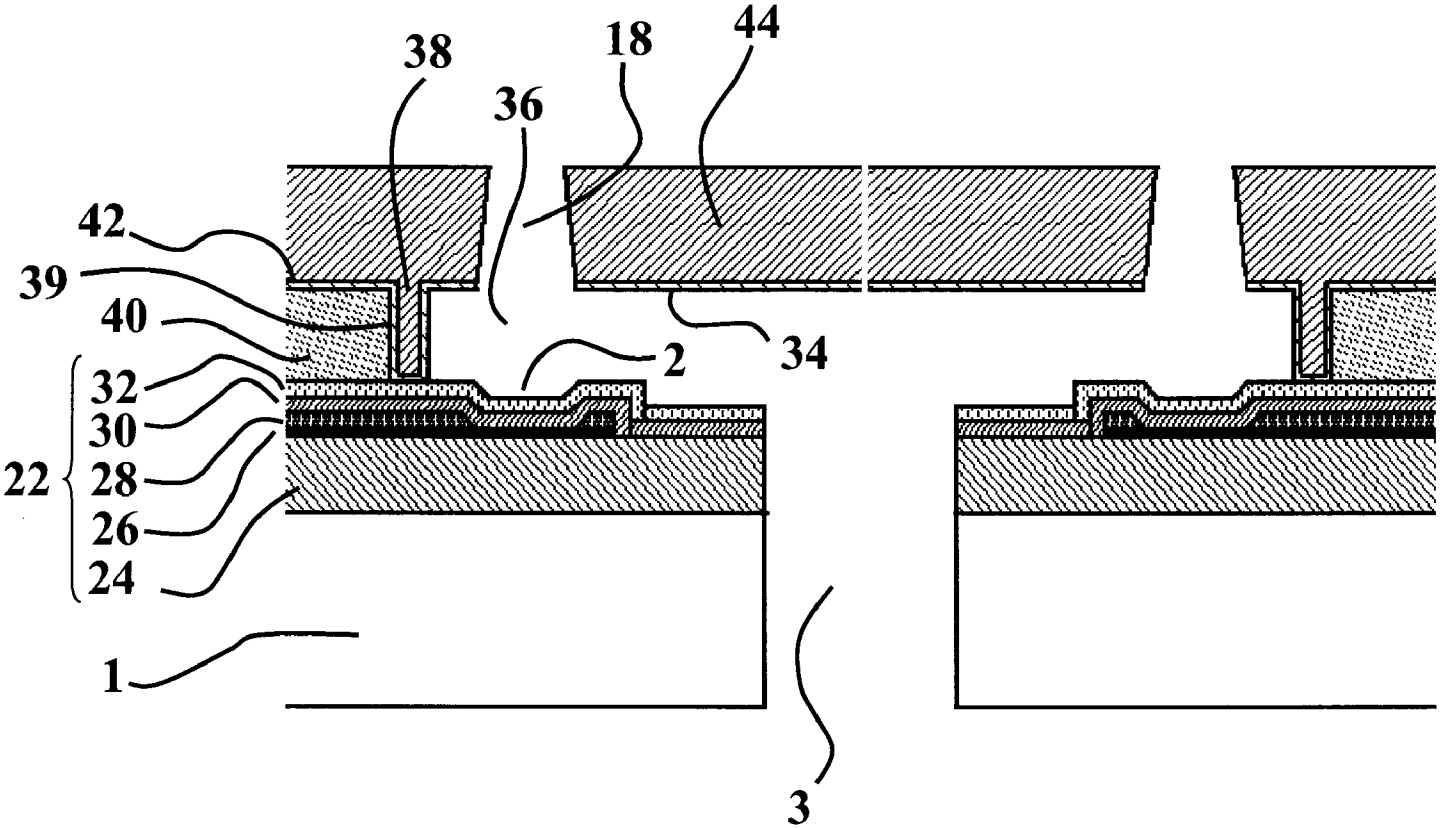

FIG. 3B is a cross-section of the embodiment shown in FIG. 3A taken through section A-A, arranged to show the nozzle region for both rows. In this embodiment a thin film stack 22 is formed or deposited on the front or first side of the substrate. The substrate 1 is silicon in one embodiment. In other embodiments the substrate 1 is one of the following: polycrystalline silicon, silica, stainless steel, or polyimide.

A thermal barrier layer 24 may be formed of a variety of materials such as deposited silicon dioxide, field oxide, glass (BPSG) and oxynitride. This layer provides thermal and electrical isolation between the electrothermal heater 2 and substrate 1. On top of the thermal barrier layer 24 is an electrically resistive heater layer 26. This electrically resistive heater layer is in this embodiment formed with a ternary Tantalum Silicon Nitride material.

An electrically conductive layer 28 is deposited on top of the electrically resistive heater layer 26. The electrically conductive layer 28 is formed from a metal typically used in MOS fabrication such as aluminum, or an aluminum alloy containing copper and/or silicon. The electrically conductive layer 28 is patterned and etched to form conductive traces which connects to the control circuitry fabricated on the ink jet printhead 20 and also defines the electrothermal heaters 2.

As shown in FIG. 3B, an insulating passivation layer 30 is next deposited. This insulating passivation layer 30 can be formed from silicon nitride, silicon oxide, and silicon carbide or any combination of these materials. On top of the insulating passivation layer 30 is deposited a protection layer 32. The protection layer 32 is formed from Tantalum, Tantalum Silicon Nitride or a combination of both materials. This layer protects the electrothermal element from the ink and also serves to protect underlying layers during the nozzle etch.

FIG. 3B also shows ink feed port 3 etched through the substrate 1, thermal barrier layer 24, insulating passivation layer 30 and protection layer 32. The ink feed port 3 in this embodiment is a long slot supplying all the nozzles. In other embodiments the ink feed port 3 can be an array of openings. The ink feed port 3 is formed using dry etching and/or wet etching.

An inner inorganic layer 34 that forms the interior walls of the ink chamber 36 is also shown in FIG. 3B. In some embodiments a liquid other than ink may be used. In one embodiment this inner inorganic layer 34 is an inorganic material such as silicon nitride, silicon oxide, amorphous silicon or silicon carbide. Other materials can be used including metals such as tantalum. The inner inorganic layer 34 is in direct contact with the ink and therefore is chosen to have advantageous properties with respect to the ink. The inner inorganic layer 34 is also in contact with the protection layer 32 and insulating passivation layer 30 (not shown). The inorganic materials selected for the inner inorganic layer 34 can be deposited at high temperature using plasma enhanced chemical vapor deposition and has excellent adhesion to the materials of these two layers. Chamber wall 38 includes two regions of inorganic material formed when inorganic layer 34 is deposited. The first region is contactable by liquid when liquid is present in chamber 36. The second region 39 of inorganic material is separated by a gap from the inorganic material which is contactable by liquid, so that this second region 39 is not contactable by liquid when liquid is present in chamber 36.

Outside of the chamber over the rest of the device area is a thick polyimide passivation layer 40, and top liner layer 42. The top liner layer 42 is deposited at the same time as the inner inorganic layer 34. The combination of passivation layer 40 and top liner layer 42 protects the device circuitry on the ink jet printhead 20 from degrading due to environmental effects and contact with the ink.

A nozzle plate organic layer 44 is deposited on top of the inner inorganic layer 34 and top liner layer 42. The nozzle plate organic layer 44 planarizes the surface of the ink jet printhead and fills in the chamber side walls 38 defined by the inner inorganic layer 34 and second region 39 of inorganic material. In one embodiment the nozzle plate organic layer 44 is a photoimageable epoxy such as SU-8 manufactured by Microchem. In another embodiment this material is polyimide or BCB or other photoimageable polymer or photosensitive silicone dielectric. The nozzle plate organic layer 44 along with the inner inorganic layer 34 defines an ink chamber 36 and defines a nozzle 18 through which the ink is ejected forming an ink drop 50 in an embodiment where ink is heated by the corresponding electrothermal element 2.

Figure 4:
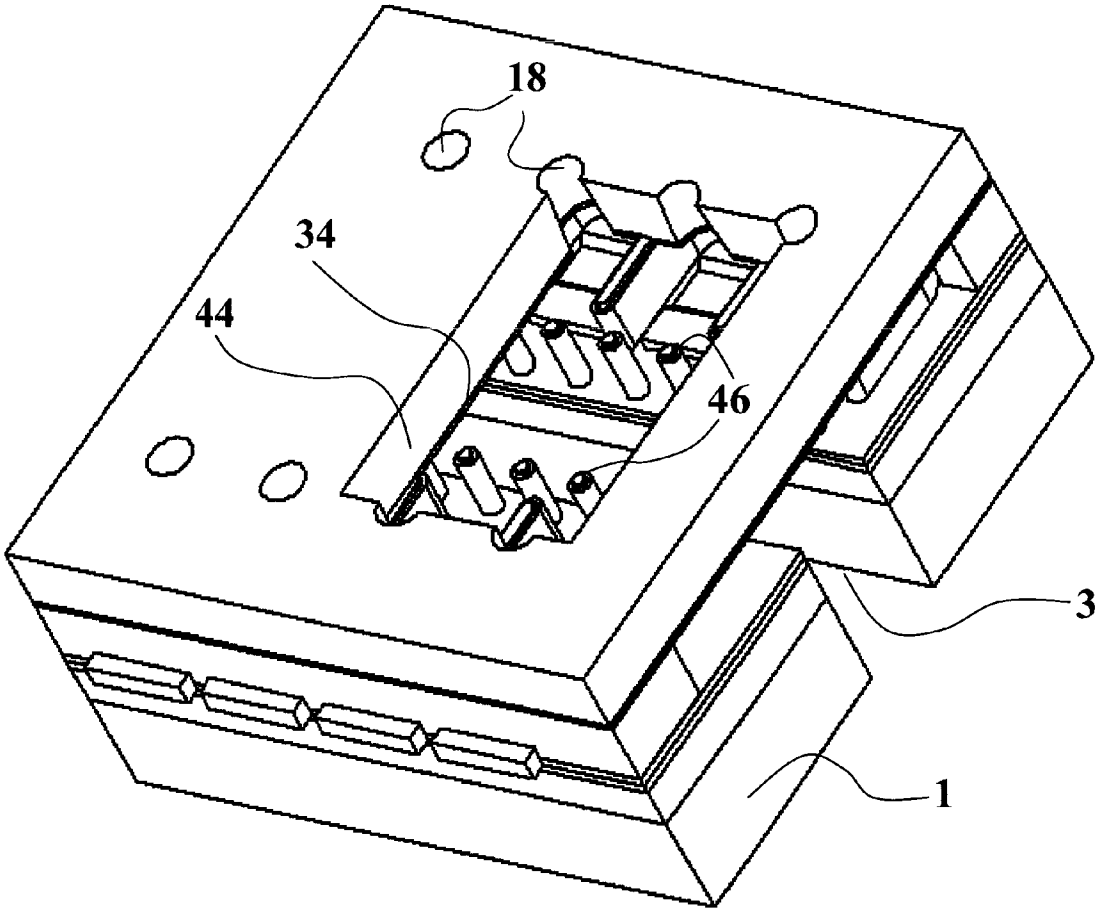
FIG. 4 is a perspective cut-away view of the embodiment of an inner liner layer and corresponding ink chamber according to the present invention.

FIG. 4 illustrates a cut-away view of the printhead of one embodiment of the present invention. An inner inorganic layer 34 and a nozzle plate organic layer 44 define the chamber walls. The ink feed port 3 in this embodiment is a long slot located between the two rows of nozzles 18. As shown in FIG. 4, in this embodiment there are also filter pillars 46 formed by the inner inorganic layer 34 and nozzle plate organic layer 44. In this embodiment they extend and are attached to the substrate 1 through the protection and insulating passivation layers. In other embodiments the filter pillars 46 can be suspended from the top chamber wall.

Figure 5A:
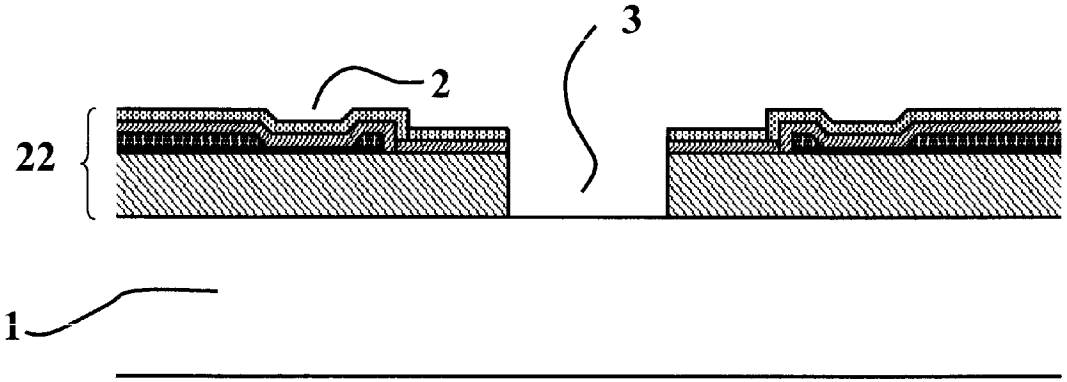
FIG. 5A-5I are cross-sectional views of an embodiment of processes for the present invention.

FIGS. 5A-5I illustrate the process of forming an ink jet printhead 20 in which the chamber is formed with a nozzle plate and includes an inner liner layer. FIG. 5A illustrates the substrate prior to chamber formation in which the driver and control circuitry (not shown) has been formed on the substrate. Also shown is the thin film stack 22, described previously, including electrothermal heater 2. The slot for the ink feed port 3 is opened up through the thin film stack down to the substrate 1.

Figure 5B:
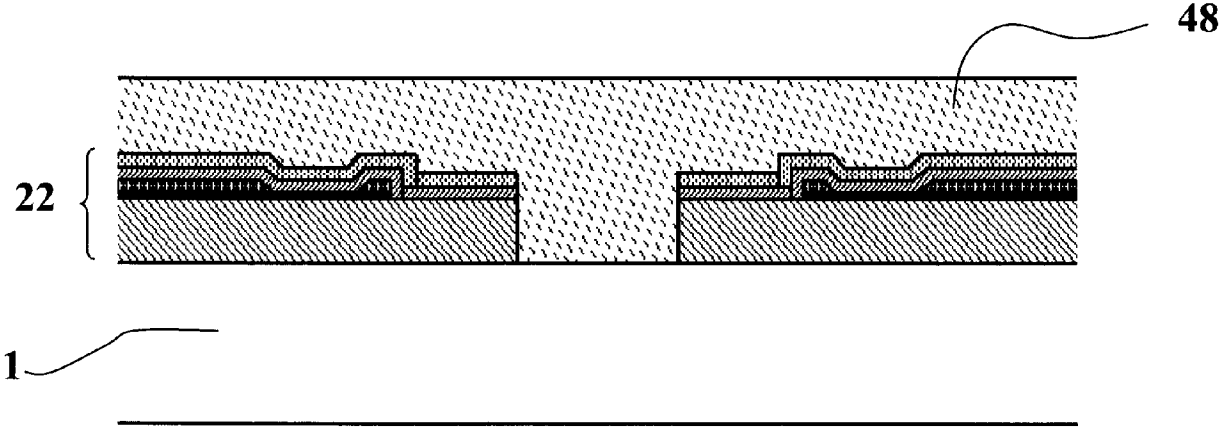

FIG. 5B illustrates one embodiment of the present invention in which a non-photoimageable polyimide 48 is coated or applied. The polyimide selected is one with low thermal coefficient of expansion, good planarization and no added components such as photoactive compounds. One such polyimide is PI2611 from HD Microsystems. The polyimide 48 defines the height of the chamber. The thickness of the polyimide 48 after imidization bake is in the range 8-16μm. In a preferred embodiment the height is 13-14μm. The imidization bake is for one hour at a temperature between 300-400 C. In this embodiment a temperature is selected that is greater than or equal to any subsequent process temperatures.

Figure 5C:
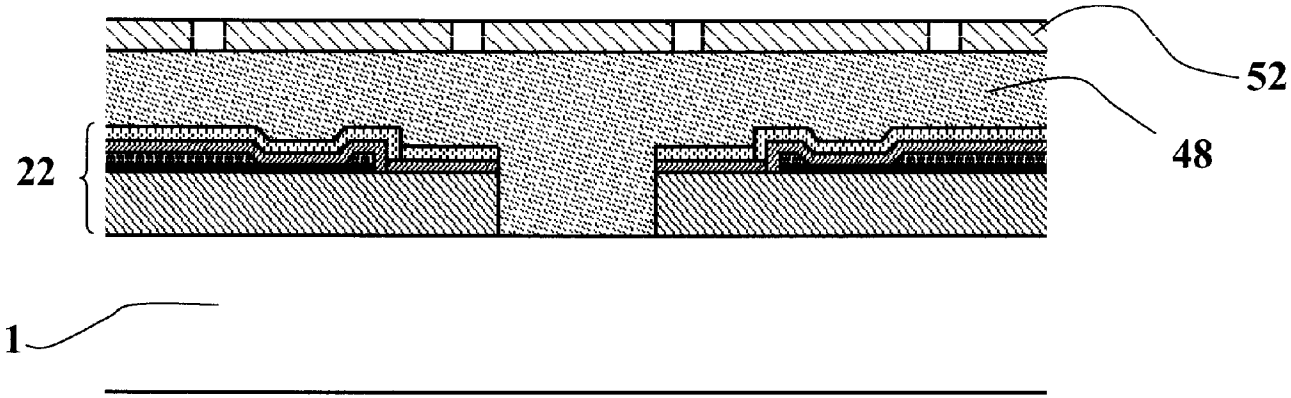
Figure 5D:
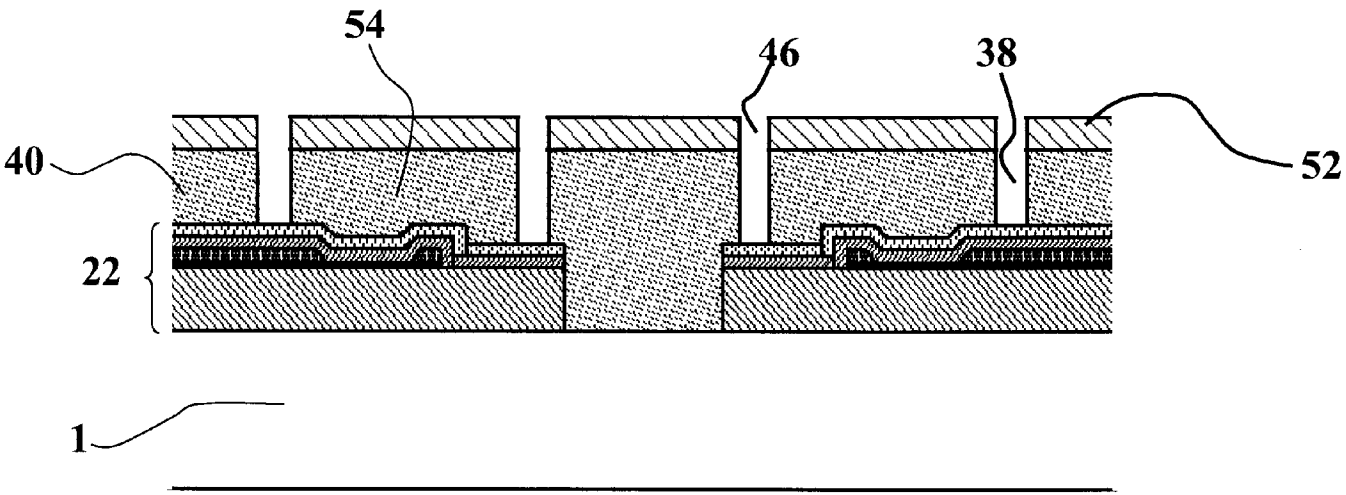

FIG. 5C shows a patterned hard mask 52 deposited on the polyimide 48. Hard mask 52 is silicon nitride, silicon oxide deposited by PECVD or aluminum deposited by sputtering. The hard mask is patterned with resist and dry etching using a fluorine-based plasma etch for nitride for example. As shown in FIG. 5D the pattern of the hard mask 52 is then transferred into the polyimide 48 using a low-pressure high-density plasma such as an inductively-coupled plasma with oxygen as the main gas component. The transferred pattern will form the chamber walls 38, pillars 46, and adhesion structures 60 (not shown). The polyimide layer 48 over the bond pad region 62 (not shown) is also removed. This low pressure inductively-coupled plasma etch produces very vertical etched profile with minimal undercut so that precise chamber geometries can be made. The hard mask 52 is then removed using a dry or wet etch. The polyimide layer is divided into two regions, the polyimide passivation layer 40 that protects the circuitry on the substrate and provides mechanical support for the nozzle plate and the sacrificial polyimide layer 54 that defines the ink chamber 36.

Figure 5E:
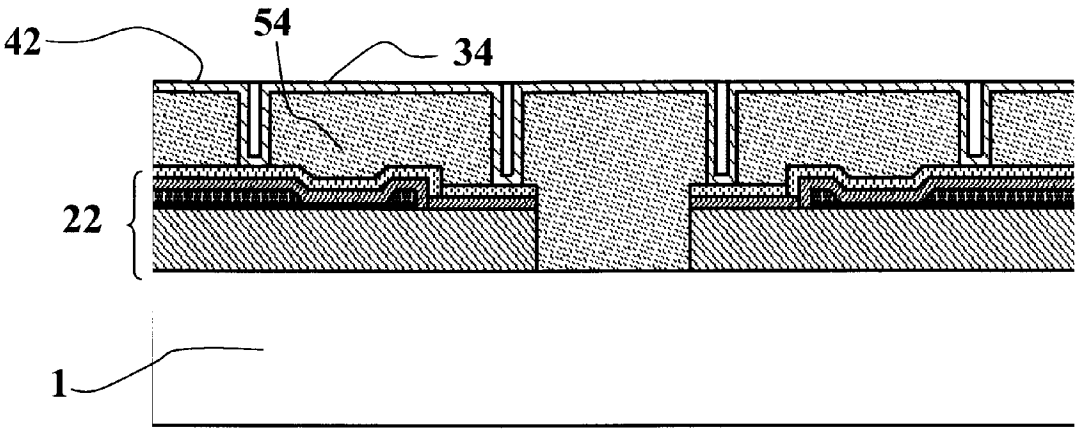

FIG. 5E illustrates the deposition of the inner inorganic layer 34, second region 39 of inorganic material, and top liner layer 42 of the present invention. In the preferred embodiment the inner liner layer is silicon nitride or silicon oxide, deposited at 350-400 C using Plasma enhanced chemical vapor deposition (PECVD). The use of a sacrificial polyimide layer 54 allows the high temperature deposition that is not possible in the prior art where resist is used as the sacrificial layer. This results in a denser higher quality material being deposited that will be more ink resistant and result in better adhesion. The choice of silicon nitride or silicon oxide as the inner liner layer imparts a hydrophilic chamber that will provide better ink filling and less likelihood of air bubble formation than an epoxy chamber of the prior art which has a low surface energy. The inner liner layer thickness is between 0.2 μm-7μm and more preferably 1-2μm. Typically this deposition technique gives 50-60% sidewall coverage for the chamber walls 38 in the present embodiment. The width of the chamber walls 38 is chosen so that the deposition of the inner liner layer leaves a gap in the chamber wall between inner inorganic layer 34 and second region 39 of inorganic material.

Figure 5F:
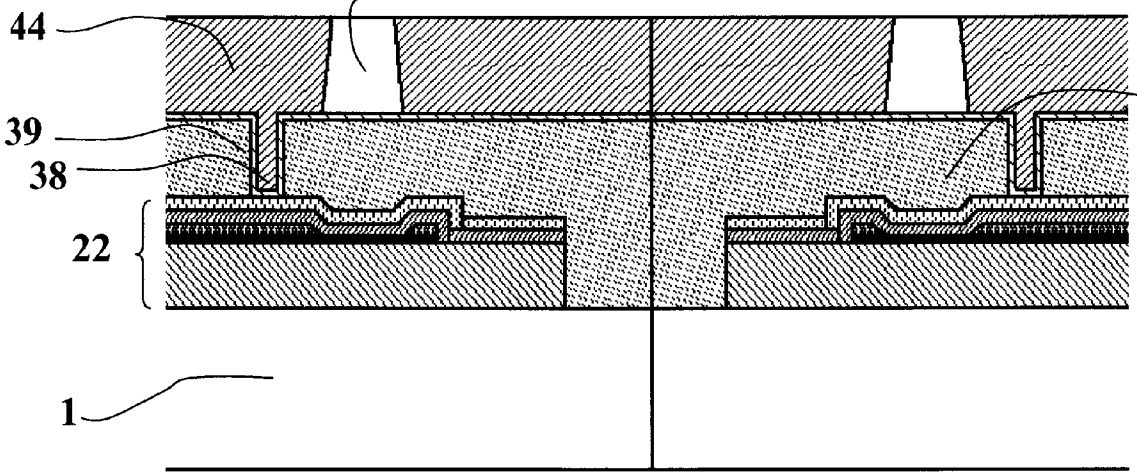

FIG. 5F illustrates coating or applying a photoimageable epoxy, forming a planarized surface for the nozzle plate organic layer 44, and filling the chamber walls 38 and filter pillars 46. The coating thickness of the photoimageable epoxy organic layer is chosen to be greater than the thickness of the inorganic liner layer. At least a portion of the organic material layer 44 is positioned between a first region of the inorganic material layer 34 and a second region 39 of the inorganic material layer. The photoimageable epoxy is exposed to form nozzles 18 that can exhibit a vertical or retrograde profile, and open up the bond pad region 62 (not shown). The thickness of the nozzle plate layer is between 3.0μm-20μm and more preferably 10-12μm.

Figure 5G:
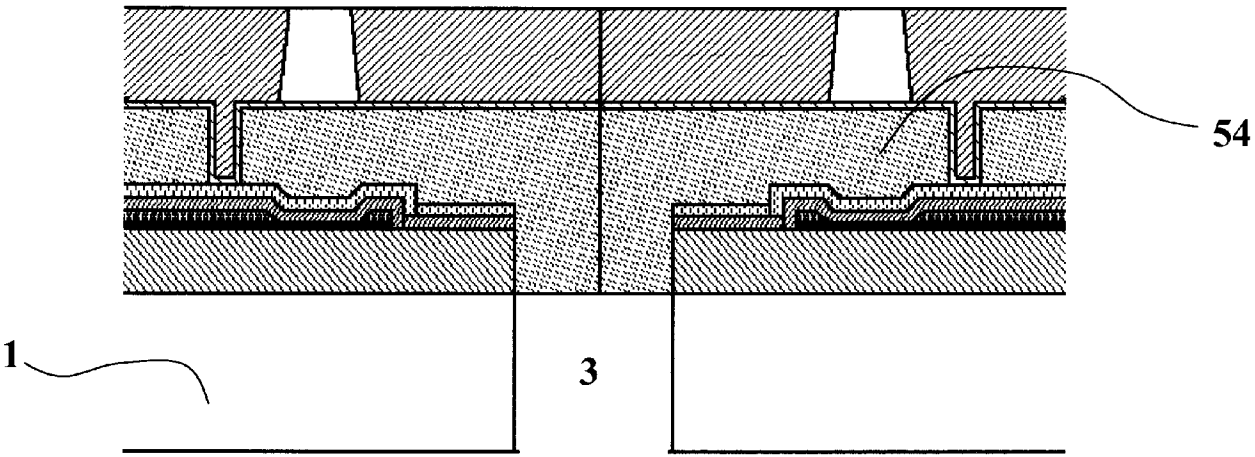

Next the substrate 1 is optionally thinned to a thickness of 300-400 μm and patterned on the back side with resist. In FIG. 5G the pattern is etched through the silicon substrate 1 using Deep reactive ion etching with the Bosch process, as is well known in the art, to form the ink feed port 3 in the substrate.

Figure 5H:
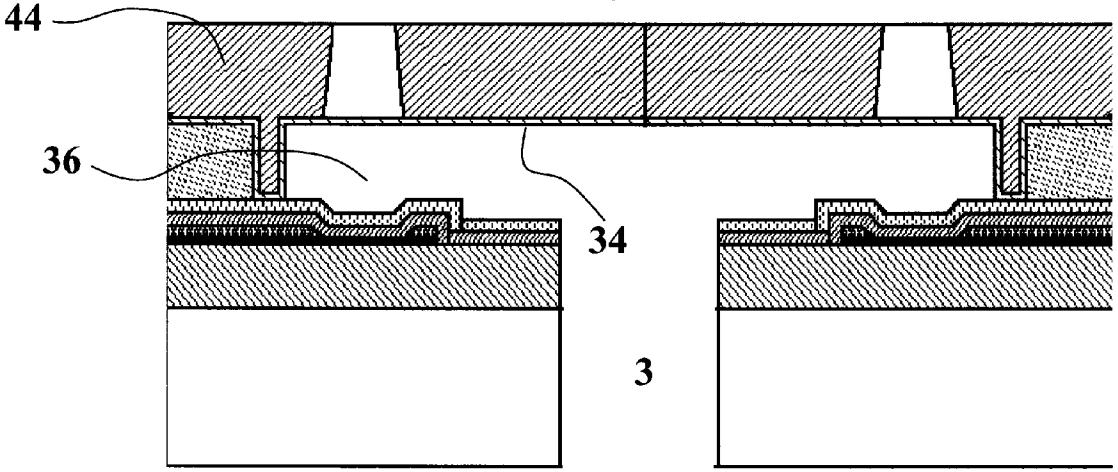

In FIG. 5H the sacrificial polyimide region is removed through the back of the substrate using an oxygen plasma through the feed port region 3 with the front side and the nozzle plate organic layer 44 protected. The inner inorganic layer 34 protects the nozzle plate organic layer 44 from being attacked by the oxygen plasma. The removal of the sacrificial polyimide layer results in formation of the ink chamber 36 and opening the top portion of the ink feed port 3.

Figure 5I:
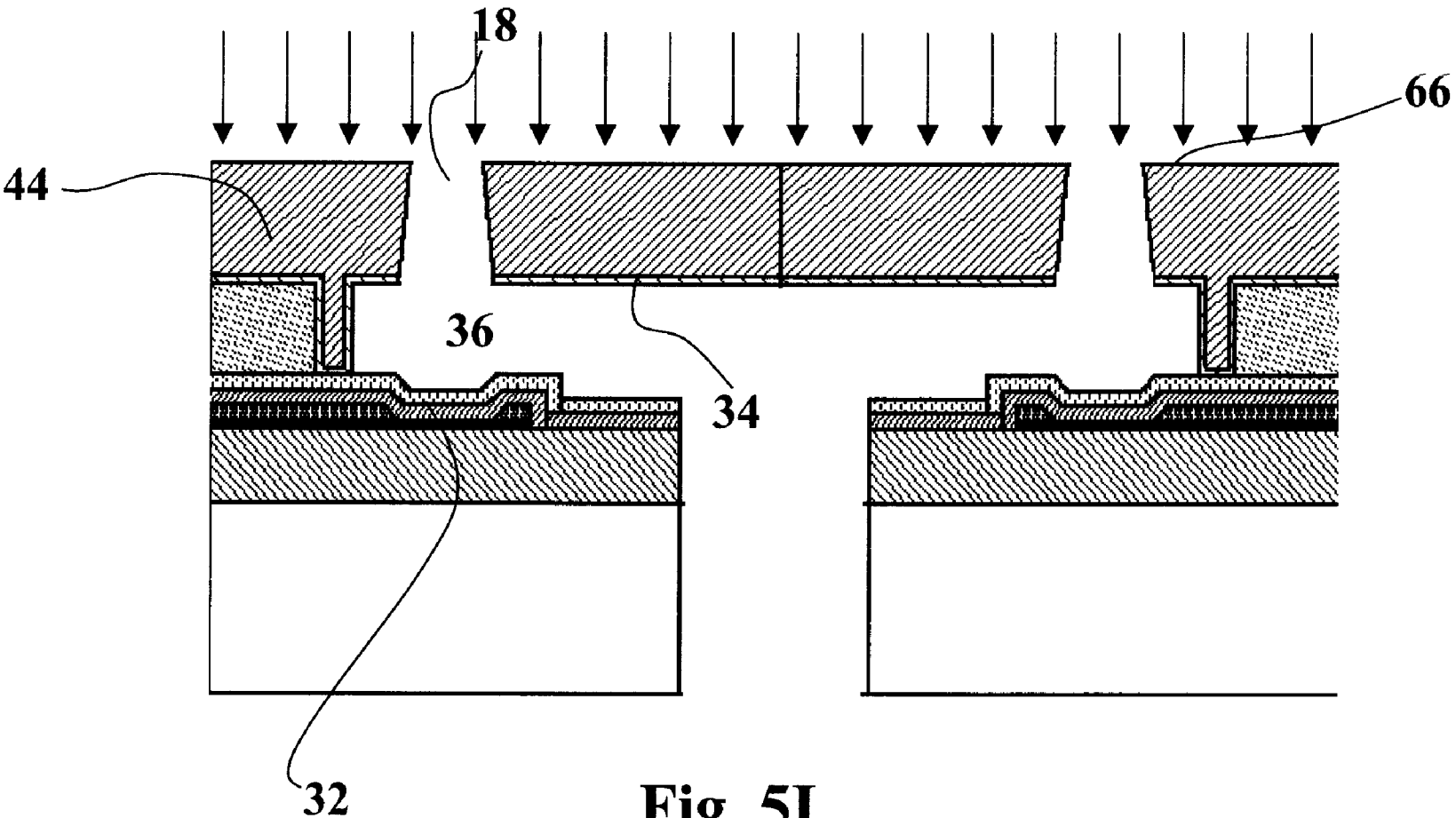

At this point in the process the inner inorganic layer 34 occludes the nozzle 18. In FIG. 5I the inner inorganic layer 34 is etched away from the nozzle region. In one embodiment the inner liner layer is silicon nitride in which case a fluorine based plasma at high pressure is used. The etch is unmasked with the nozzle plate organic layer 44 acting as an etch mask since it is selective to the nitride etch. The protection layer 32 is also selective to the plasma etch and protects the heater region from attack. In an alternative embodiment the inner liner layer is silicon oxide. In this case an HF vapor etch can be used to remove the oxide from the nozzle region.

The operation of the device is as follows. An electrical pulse is applied to the electrothermal heater 2. The heat pulse causes nucleation of a bubble in the chamber that grows, expelling ink from the ink chamber 36 through the nozzle 18 in the form of a drop, and also pushing ink back toward the ink feed port emptying most of the ink chamber of ink. The ejection frequency of the device is limited by the time it takes to refill the ink chamber 36. A hydrophobic chamber wall will increase the refill time causing incomplete refill of the chamber before the next firing pulse. This in turn results in ejection of a smaller and misdirected drop or in the worst case, no drop. A hydrophobic chamber wall also has a larger tendency to trap bubbles during refill. Bubbles trapped in the chamber of ink feed port again degrade the drop ejection. Organic materials used in the prior art are more hydrophobic than the inorganic liner layer of the present invention. The present invention gives the freedom to adjust the chamber to be hydrophilic by the use of inorganic materials that have a higher surface energy for water-based inks.

We have also found that the high temperature, plasma deposited silicon nitride and silicon oxide forming the chamber walls 38 have better adhesion to the protection and passivation layers on the substrate than epoxy based materials. Thus the device is more robust for long term resistance to delamination.

The added use of an organic based nozzle plate allows the printhead to be mechanically robust and easy to manufacture. Thus the advantages of an epoxy-based nozzle plate are retained with the disadvantages reduced or even eliminated.

It may be advantageous depending on the contemplated application for the nozzle plate surface 66 to be non-wetting with the ink. A non-wetting nozzle plate surface improves the directional stability of the ejected drop and reduces residual ink surface flooding. The advantage of an epoxy based nozzle plate is that the material is somewhat non-wetting. It has been found that the non-wetting of nozzle plate surface can be increased by exposure to a fluorine and/or fluorocarbon based plasma. This can be accomplished during the nozzle-opening step of FIG. 5I.

Figure 6:
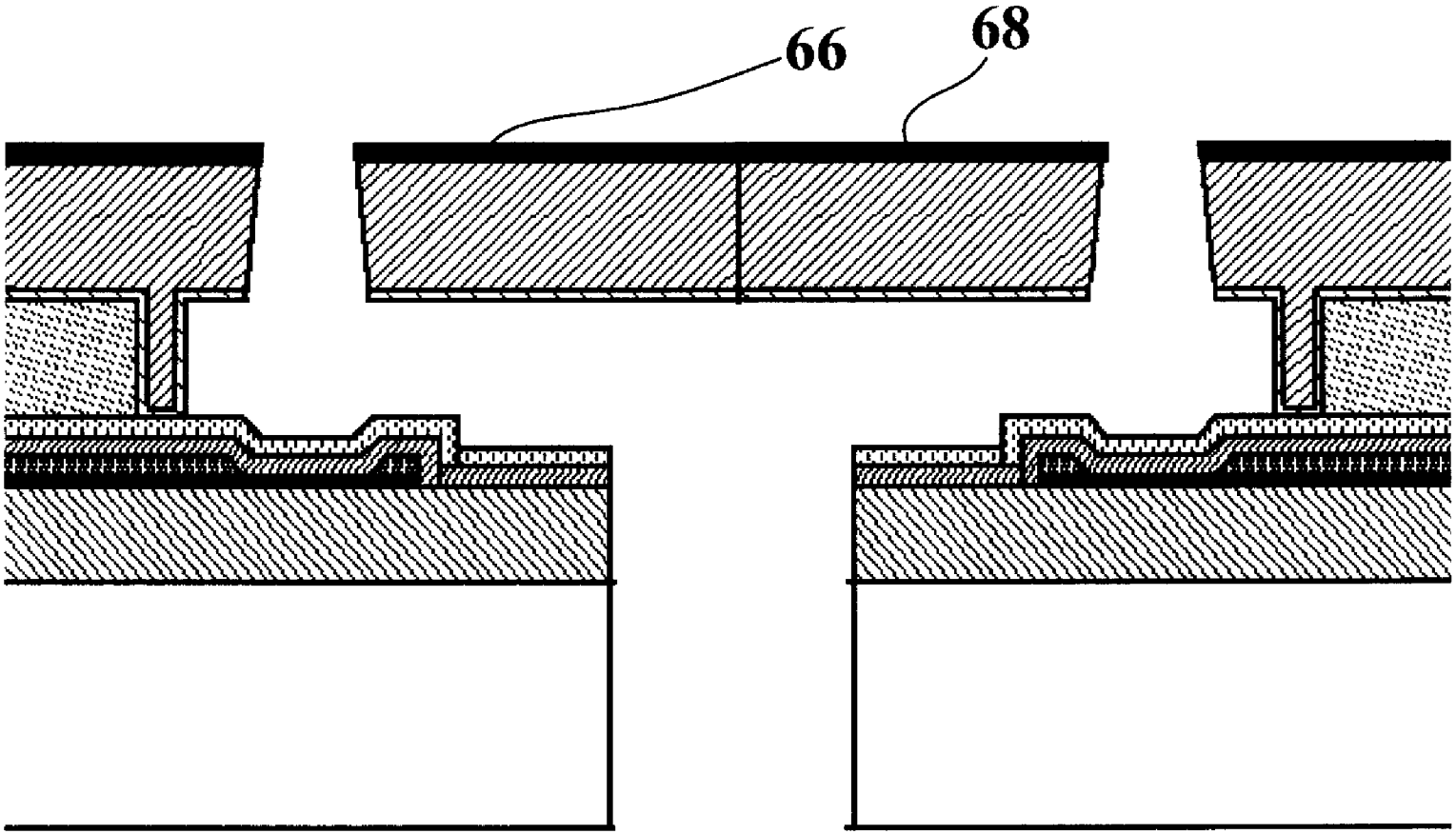
FIG. 6 is a cross-sectional view of an embodiment of a process for generating a non-wetting nozzle plate surface for the present invention.

Alternatively a separate step can be used. In FIG. 6 a fluorinated surface layer 68 is formed. In one embodiment a low pressure highly directional plasma is used to ensure only the top surface is fluorinated.

As an example, the contact angle of a water-based ink was measured before and after fluorination of SU-8. Prior to fluorination the contact angle measured 63°. The fluorination was carried out in an inductively coupled plasma (ICP) system operating at 5 mT, RF power 30W, ICP power 2000W, $C_4F_8$ flow rate 11 sccm, and a time of 5 minutes. After fluorination the contact angle increased to 89°.

Figure 7:
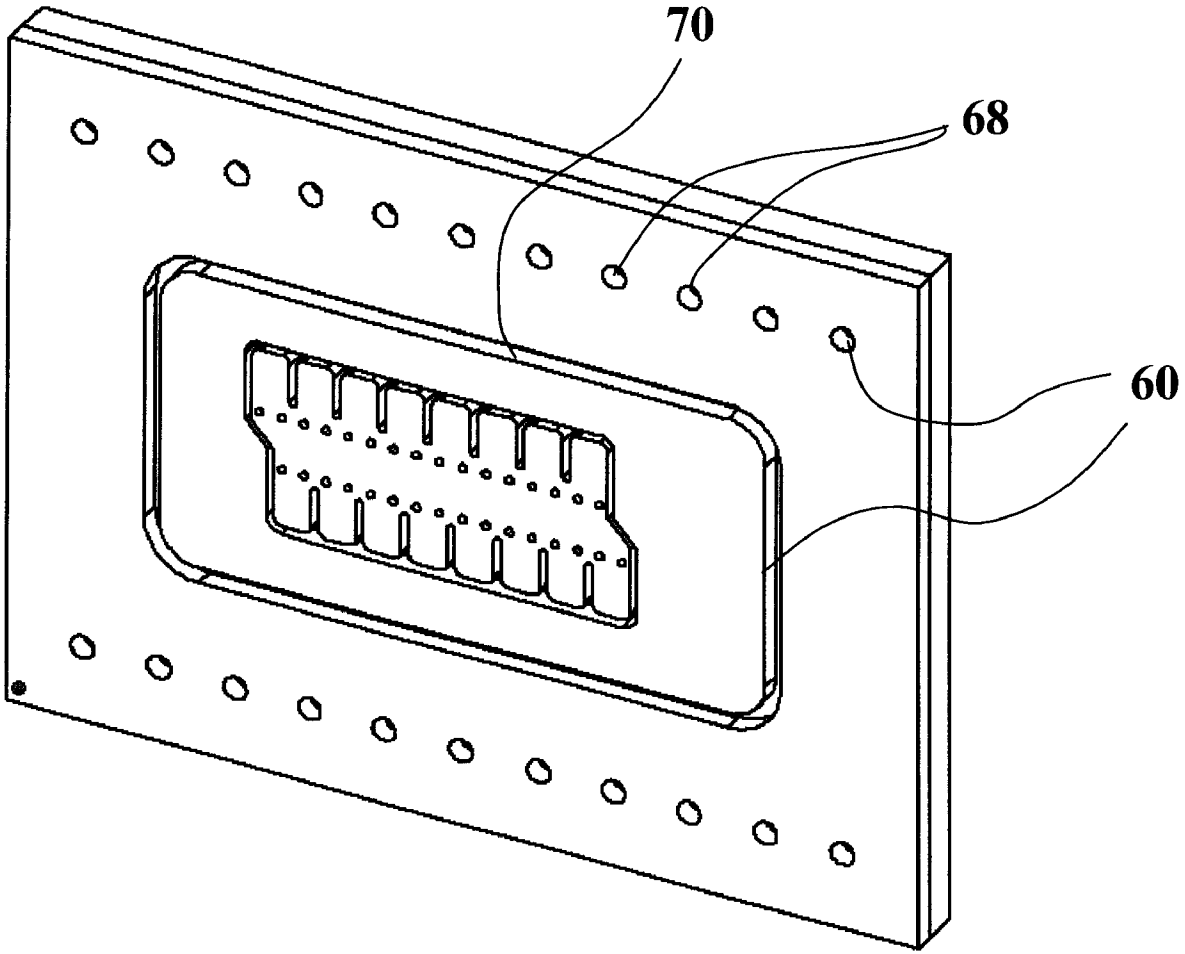
FIG. 7 is a perspective view of the ink jet printhead showing clamping structures etched into the polyimide passivation layer according to the present invention.

In an alternative embodiment we have found that adhesion of the nozzle plate organic layer 44 across the printhead can be improved by the inclusion of clamping structures 60. This embodiment is illustrated in FIG. 7 and shows a view of part of a printhead after the step illustrated in FIG. 5E is completed. The clamping structures 60 are formed similarly to the chamber walls 38. The clamping structures can be walls 68, or isolated openings 70. When the SU-8 epoxy is coated, as in the step illustrated in FIG. 5F, the epoxy will flow into and fill the clamping structures 60 increasing the adhesion surface area for the epoxy.

In a second embodiment, additional steps can be added to vary the ink chamber height across the printhead. In particular, when ejecting drops with different volumes from nozzles on the same printhead it is desirable to adjust the chamber height while leaving the feed port region height constant. In this second embodiment the process is similar to that shown in the embodiment of FIG. 5 up to and including the step illustrated by FIG. 5B. FIG. 8 illustrates a continuation of the process using a second embodiment of the present invention.

Figure 8A:
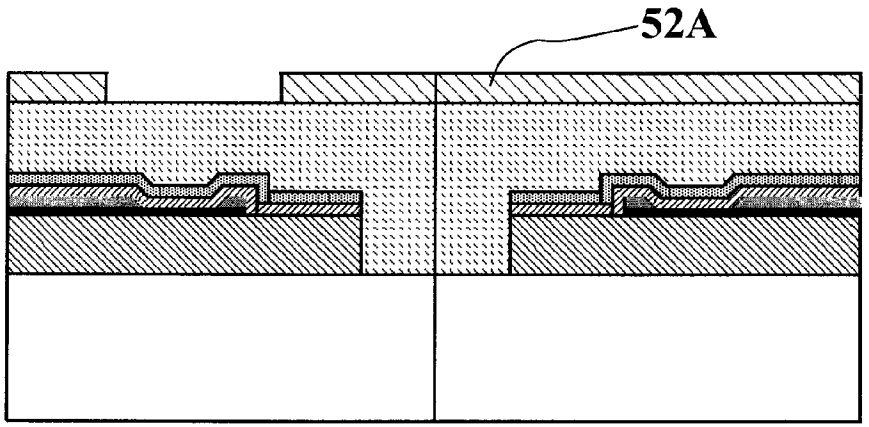
FIG. 8A-8G are cross-sectional views of a second embodiment of processes for the present invention.
Figure 8B:
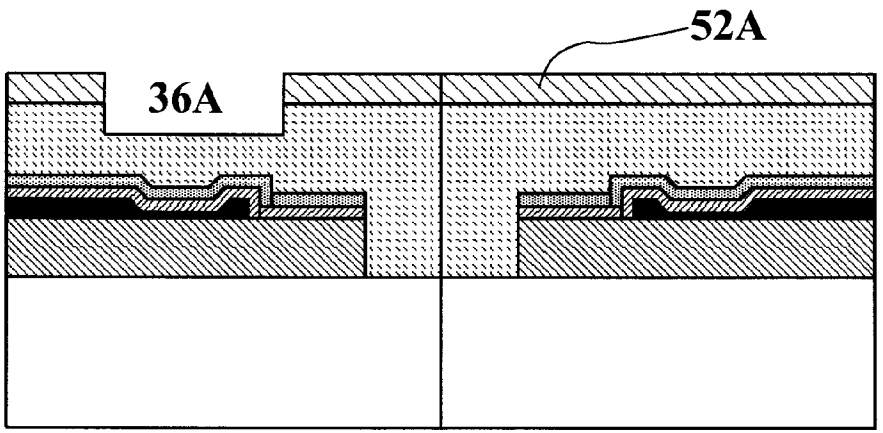
Figure 8C:
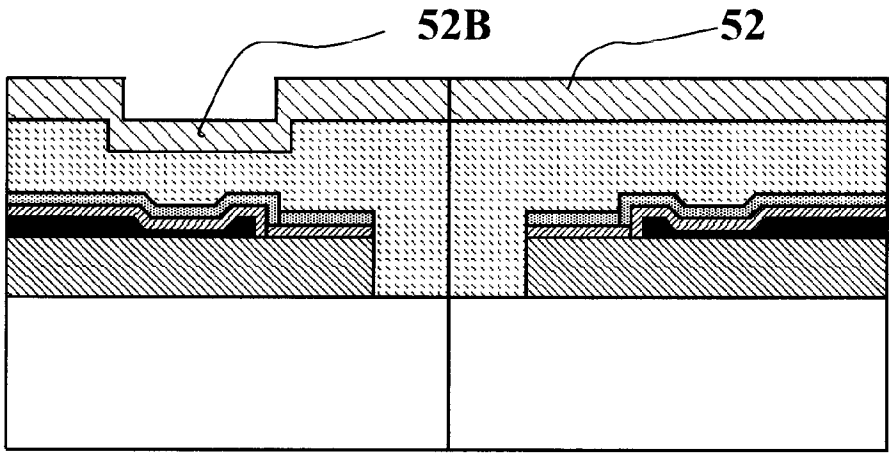

As illustrated in FIG. 8A, a first hard mask 52A is deposited and patterned. As shown in FIG. 8B the polyimide layer 48 is partially etched in a region that will form the lowered ink chamber 36A. As shown in FIG. 8C a second hard mask 52B is deposited. In a preferred embodiment the first hard mask 52A is left on so that second hard mask 52B is a combination of the two layers forming hard mask 52. In another embodiment the first hard mask can be removed prior to the second hard mask deposition.

Figure 8D:
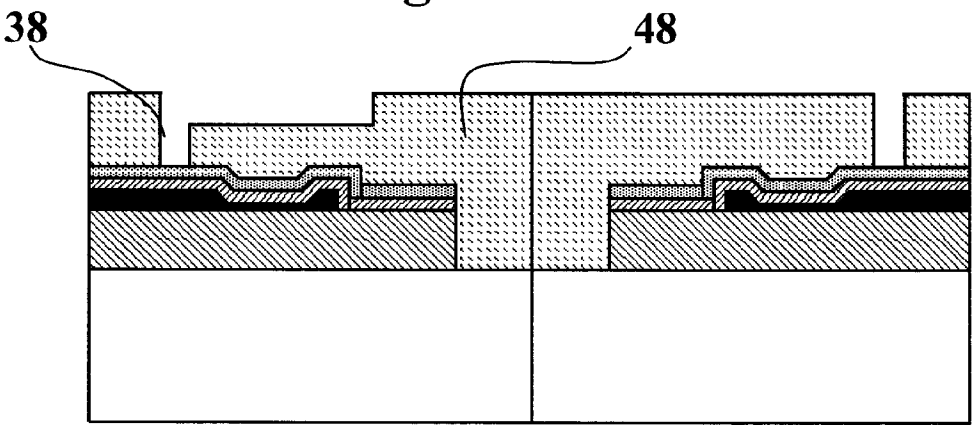

At this point the processing returns to the processing steps illustrated in FIGS. 5C-5I. As illustrated in FIG. 8D, the hard mask is patterned with a second pattern similar to FIG. 5C.

The pattern of the hard mask 52 is then transferred into the polyimide 48 using a low pressure inductively-coupled plasma with oxygen as the main gas component. The transferred pattern will form the chamber walls 38, filter pillars 46, and adhesion structures 60. The polyimide layer 48 over the bond pad region 62 (not shown) is also removed. This low pressure inductively-coupled plasma etch produces very vertical etched profile with minimal undercut so that precise chamber geometries can be made. The hard mask 52 is then removed using a dry or wet etch. The polyimide layer is divided into two regions, the polyimide passivation layer 40 that protects the circuitry on the substrate and the sacrificial polyimide layer 54 that defines the ink chamber 36.

Figure 8E:
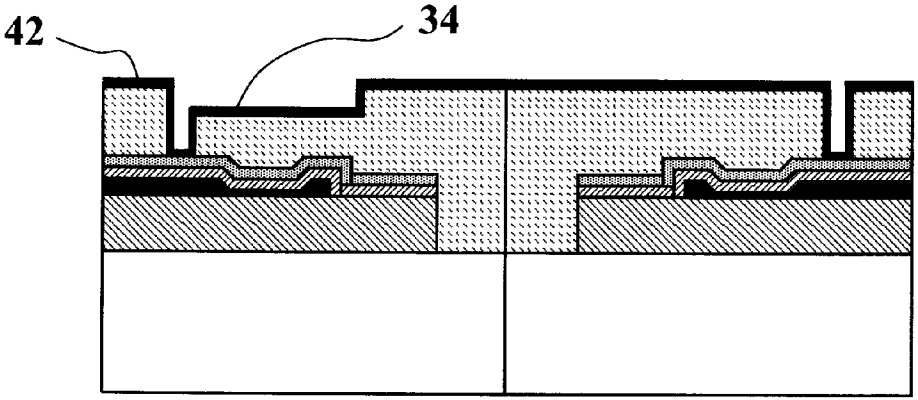
Figure 8F:
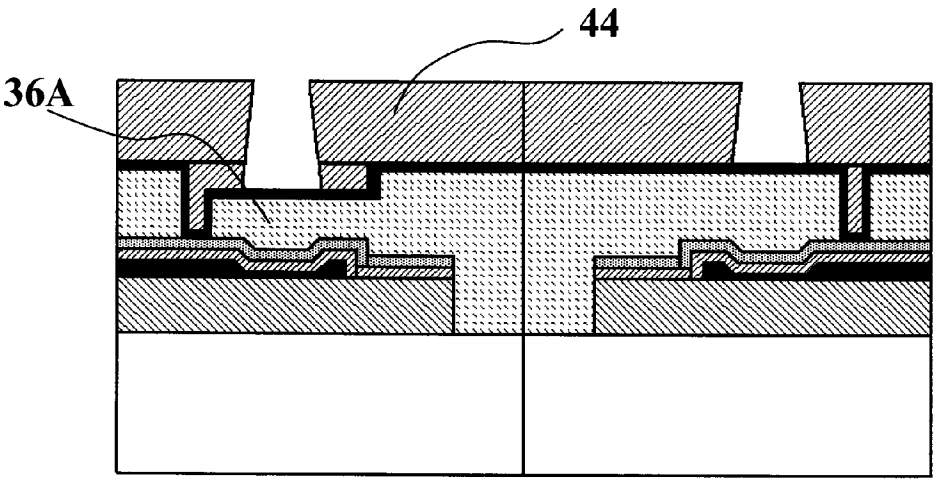

FIG. 8E illustrates the deposition of the inner inorganic layer 34 and top liner layer 42 of the present invention. FIG. 8F illustrates coating or applying a photoimageable epoxy, namely SU-8 is coated, forming a planarized surface for the nozzle plate organic layer 44, and filling the chamber walls 38 and filter pillars 46. The SU-8 is exposed to form nozzles 18 that show a retrograde profile and open up the bond pad region 62 (not shown). The thickness of the nozzle plate layer is between 3.0 μm-20μm and more preferably 10-12μm. In this second embodiment the nozzle plate layer will be thicker in the Lowered ink chamber 36A region so that the nozzle is correspondingly thicker.

Figure 8G:
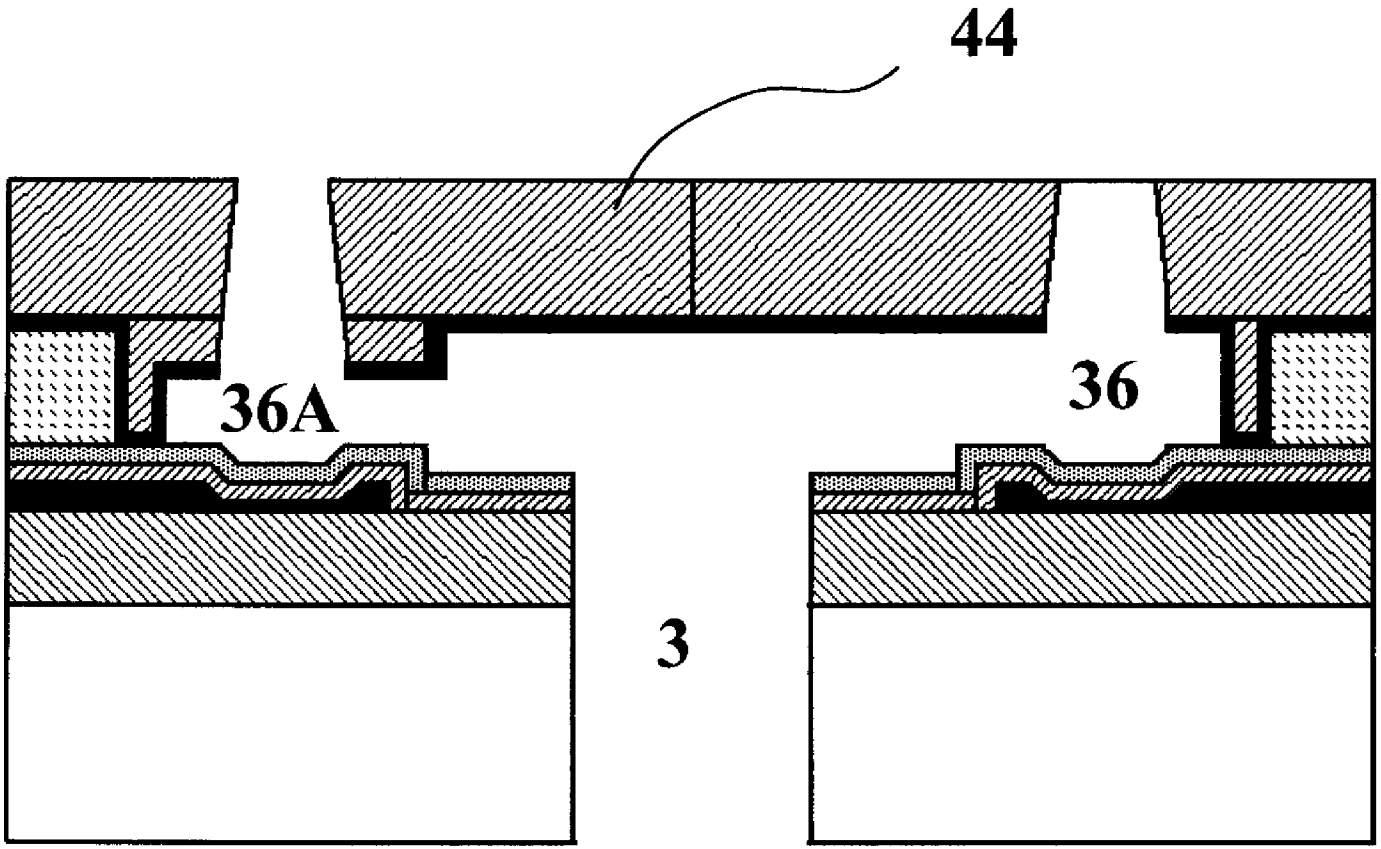

FIG. 8G illustrates the finished printhead after the steps illustrated in FIGS. 5G-5I have been completed. As illustrated in the figure, in one embodiment the lowered ink chamber is performed on a subset of the nozzles. In another embodiment the lowered ink chamber process is performed on all the ink chambers. In this process it is seen that the ink feed port region 3 has maximum height to optimize ink refilling while the lowered ink chamber 36A has a height adjusted to maximize ink ejection.

From the foregoing, it will be seen that this invention is one well adapted to obtain all of the ends and objects. The foregoing description of preferred embodiments of the invention has been presented for purposes of illustration and description. It is not intended to be exhaustive or to limit the invention to the precise form disclosed. Modification and variations are possible and will be recognized by one skilled in the art in light of the above teachings. For example, the present invention is not limited to chamber formation of thermal bubble jet devices but also includes chamber formation for other drop ejection methods such as thermal or electrostatic actuator or piezoelectric activated liquid devices. Such additional embodiments fall within the scope of the appended claims.

PARTS LIST

1 Substrate
2 Electrothermal elements
3 Ink feed port
4 Chamber
5 Photopatternable resin
10 Ink jet printing system
12 Image data source
14 Controller
16 Pulse source
18 Nozzle
20 Inkjet printhead
22 Thin film stack
24 Thermal barrier layer
26 Resistive Heater layer
28 Electrically conductive layer
30 Insulating passivation layer
32 Protection layer
34 Inner inorganic layer
36 Ink chamber
36A Lowered ink chamber
38 Chamber side walls
39 Second region of inorganic material
40 Polyimide passivation
42 Top liner layer
44 Nozzle plate organic layer
46 Filter pillars
48 Non-photoimageable polyimide
50 Ink drop
52 Hard mask
52A $1^{st}$ hard mask layer
52B $2^{nd}$ hard mask layer
54 Sacrificial polyimide region
60 Clamping structures
62 Bond pad region
66 Nozzle plate surface
68 Modified surface layer
70 Second liner layer
100 Recording medium

What is claimed is:

1. A liquid ejector comprising:

a) a substrate including an ink feed port;

b) an electrothermal element; and c) a chamber tor receiving a liquid, the chamber being positioned over the substrate, wherein the chamber comprises:

i) a nozzle plate including an organic material;

ii) a chamber wall including an organic material, the chamber wall being disposed proximate to the electrothermal element and distal to the ink feed port; and iii) a liner layer including an inorganic material, the liner layer being located on the nozzle plate and the chamber wall such that a first region of inorganic material is contactable with the liquid when the liquid is present in the chamber.

2. The liquid ejector according to claim 1, wherein the nozzle plate includes a nozzle bore having no liner layer located within the nozzle bore.

3. The liquid ejector according to claim 1, the inorganic material of the liner layer including a thickness and the organic material including a thickness, wherein the thickness of the inorganic material is less than the thickness of the organic material.

4. The liquid ejector according to claim 3, wherein the inorganic material of the liner layer is between 0.2 μm-7 μm.

5. The liquid ejector according to claim 1, wherein the organic material of the chamber wall is positioned between the first region of inorganic material of the liner layer and a second region of inorganic material that is not contactable with the liquid when the liquid is present in the chamber.

6. The liquid ejector according to claim 5, further comprising:

a region of organic material located relative to the region of inorganic material that is not contactable with the liquid when the liquid is present in the chamber such that the region of inorganic material that is not contactable with the liquid when the liquid is present in the chamber is between the region of organic material and the organic material of the chamber wall.

7. The liquid ejector according to claim 6, wherein the region of organic material that is located relative to the region of inorganic material that is not contactable with the liquid when the liquid is present in the chamber is a polyimide.

8. The liquid ejector according to claim 5, wherein a third region of inorganic material is positioned to cover a bottom portion of the chamber wall.

9. The liquid ejector according to claim 1, the nozzle plate including an outer surface, wherein the outer surface of the nozzle plate includes fluorine.

10. The liquid ejector according to claim 1, the nozzle plate having a first thickness over the chamber, further comprising:

an ink feed port, the nozzle plate having a second thickness over the ink feed port, wherein the first thickness is greater than the second thickness.

11. The liquid ejector according to claim 1, the chamber being a first liquid chamber having a first height, further comprising:

a second liquid chamber having a second height, wherein the first height is greater than the second height.

12. The liquid ejector according to claim 1, the chamber being a first liquid chamber, the nozzle plate having a first thickness over the first liquid chamber, further comprising:

a second liquid chamber, the nozzle plate having a second thickness over the second liquid chamber, wherein the second thickness is greater than the first thickness.

13. The liquid ejector according to claim 1, further comprising a clamping structure located between the nozzle plate and the substrate.

* * * * *

UNITED STATES PATENT AND TRADEMARK OFFICE

CERTIFICATE OF CORRECTION

PATENT NO. : 7,699,441 B2
APPLICATION NO. : 11/609375
DATED : April 20, 2010
INVENTOR(S) : John Andrew Lebens It is certified that error appears in the above-identified patent and that said Letters Patent is hereby corrected as shown below:

Description of Error

| Column | Line | |
|---|---|---|
| 10 | 27 | In Claim 1, delete "tor" and insert -- for --, therefor. |

Signed and Sealed this
Twelfth Day of July, 2011

David J. Kappos

David J. Kappos
*Director of the United States Patent and Trademark Office*